United States Patent [19]

DiFede

[11] 3,938,213

[45] Feb. 17, 1976

[54] SCORECARD WASHING DEVICE

[76] Inventor: Dominic DiFede, 25803 Kay Ave., Hayward, Calif. 94545

[22] Filed: May 17, 1974

[21] Appl. No.: 470,710

[52] U.S. Cl. ..... 15/77; 15/100
[51] Int. Cl.[2] ..... A46B 13/04; B08B 1/02
[58] Field of Search ..... 15/4, 77, 102, 100

[56] References Cited

UNITED STATES PATENTS

| | | | |
|---|---|---|---|
| 1,817,332 | 8/1931 | Worrall | 15/77 |
| 2,282,628 | 5/1942 | Whann et al. | 15/77 X |
| 2,543,657 | 2/1951 | Brown, Jr. | 15/77 |
| 3,237,231 | 3/1966 | Zink | 15/102 |
| 3,562,834 | 2/1971 | Stievenart et al. | 15/77 |
| 3,694,071 | 9/1972 | Touchette | 15/77 X |
| 3,792,503 | 2/1974 | Brock | 15/4 |
| 3,800,349 | 4/1974 | Green | 15/4 |

*Primary Examiner*—Edward L. Roberts
*Attorney, Agent, or Firm*—Bruce & McCoy

[57] ABSTRACT

A device for washing and drying reusable scorecards utilizing a tank having an inlet aperture and an outlet aperture. A means is also included for conveying the scorecard edgewise through the tank and through a scrubbing station and a drying station. The scrubbing station is submerged in a cleaning fluid contained in the tank whereby fluid is supplied to the scorecard during the scrubbing operation. A means for drying the scorecard is located at the drying station which comprises a pair of revolving wringer rollers operable to remove the cleaning fluid from the scorecard.

1 Claim, 3 Drawing Figures

SCORECARD WASHING DEVICE

BACKGROUND OF THE INVENTION

1. Field of the Invention

The present invention relates generally to a washing device for sheets of material and, more particularly, to a device for washing and drying reusable transparent scorecards such as are used for recording bowling scores and the like.

2. Description of the Prior Art

Numerous complicated devices and machines for cleaning and drying sheets of various materials are generally known in the art. However, a simple and inexpensive device for quickly and easily removing grease pencil markings and the like from preprinted transparent plastic scorecards at convenient locations in the bowling alley have not heretofore been deemed to be commercially feasible. Such transparent scorecards are generally utilized in conjunction with a light projector in order to display a number of bowling game scores on a large screen as the game progresses. At the present time, after a game is completed such marks are manually removed by means of a cloth and solvent which has proven to be a messy and time consuming task for the bowler.

SUMMARY OF THE INVENTION

The present invention is a device for washing and drying such scorecards quickly and easily by means of conveying the used scorecard edgewise through a tank which includes a scrubbing station submerged in a cleaning fluid and drying station which is operable to remove the residual cleaning fluid from the scorecard before it exits from the device. The present invention is simple in its operation and construction and relatively inexpensive to manufacture, thereby rendering it a practical and efficient alternative to the hand cleaning of such scorecards by the bowler.

DESCRIPTION OF THE PREFERRED EMBODIMENT

Figure 1:
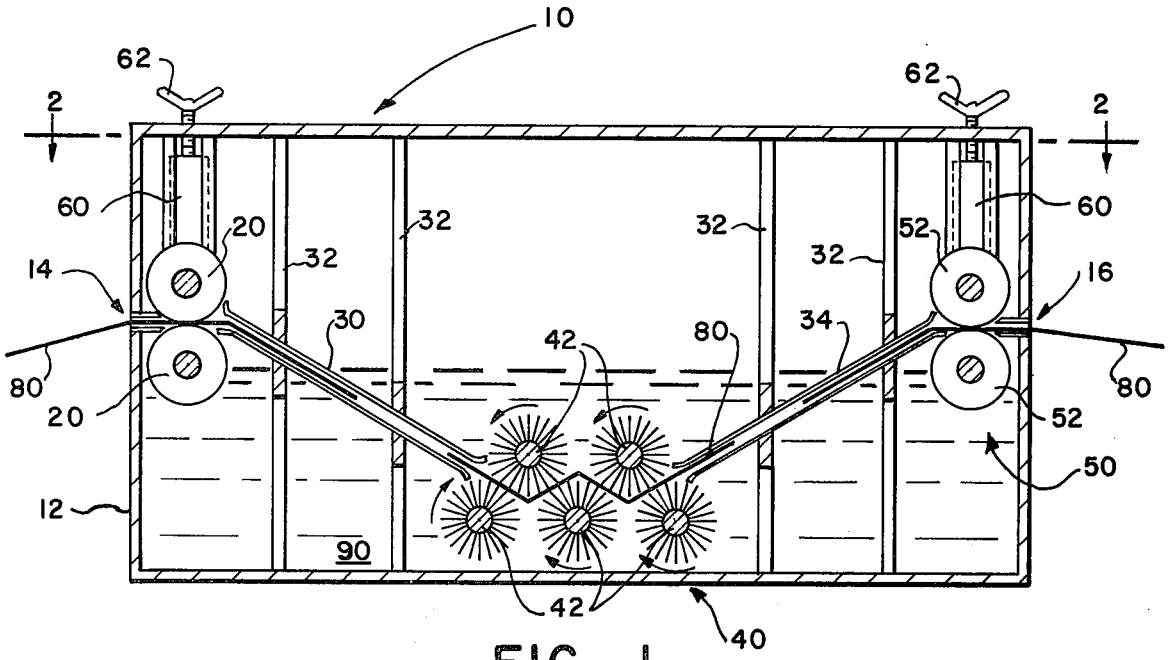
FIG. 1 is a side elevation view in section of an embodiment of a scorecard washing device constructed in accordance with the present invention.
Figure 2:
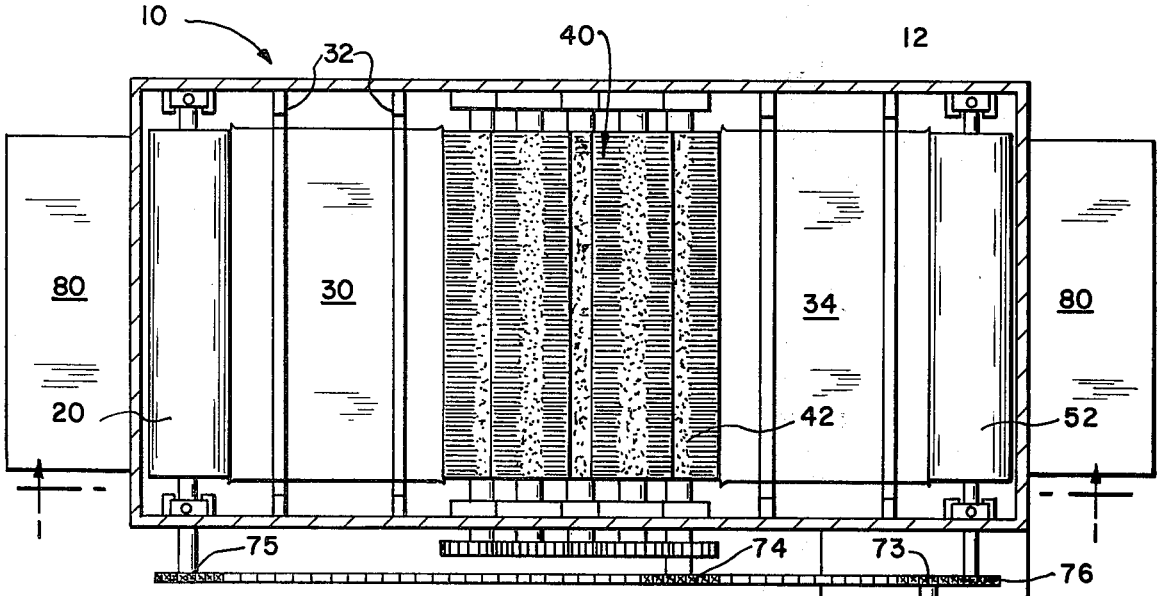
FIG. 2 is a top sectional view of the scorecard washing device taken along line 2—2 of FIG. 1.

Referring to FIGS. 1 and 2, there is illustrated an embodiment of a scorecard washing device, indicated generally at 10, constructed in accordance with the present invention. The scorecard washing device 10 includes a tank 12 having a horizontal inlet aperture 14 located at one end and a horizontal outlet aperture 16 located at the other end.

A pair of revolving feeder rollers 20 are located at inlet aperture 14 for receiving a scorecard 80 as it is fed edgewise into the inlet aperture and propelling it downward through guides 30 to scrubbing station 40.

Figure 3:
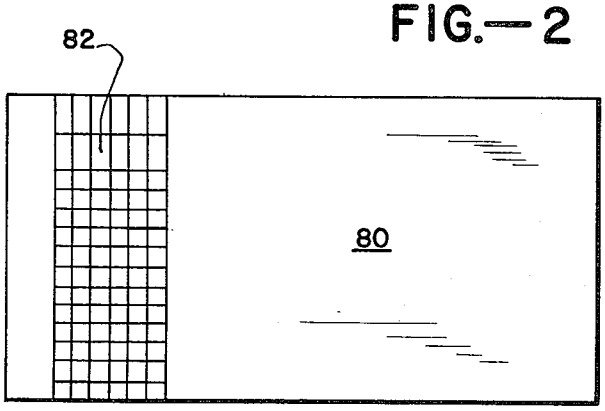
FIG. 3 is a top view of a transparent scorecard which may be utilized with the present invention.

As is best illustrated in FIG. 3, scorecard 80 may typically comprise a large rectangular sheet of transparent material, such as plastic or acetate, which is preprinted with indelible markings 82 which generally provide spaces for identification of the bowler, handicap, frame number and scores. As the game progresses, the scores are entered on the scorecard by the scorekeeper with a grease pencil and light is projected through the transparent scorecard which in turn projects the markings entered on the scorecard on a large overhead screen.

Guides 30 are parallel flat rigid pieces of material held into place by interior braces 32. The scorecard passes between the guides as it moves from station to station. The purpose of the guides is to positively guide the scorecard as it passes through the device and to prevent bending of it during the washing and drying operations.

Scrubbing station 40 is submerged in a cleaning fluid 90 contained in said tank 12 so that the fluid is supplied to the scorecard during the scrubbing operation. Such cleaning fluid may be water or a special solvent to help dissolve the grease pencil markings during the scrubbing operation.

Scrubbing station 40 includes multiple revolving cylindrical brushes 42 which are positioned above and below the scorecard as it passes through the scrubbing station and are in contact at all times with it. In this manner both sides of the scorecard are washed simultaneously with equal pressures being applied thereto. As is shown in FIG. 1, the brushes positioned above the scorecard revolve in a counterclockwise direction and those positioned below the scorecard revolve in a clockwise direction, thereby propelling the scorecard to the drying station 50 through guides 34 which are similar to guides 30.

Drying station 50 comprises a pair of revolving wringer rollers 52 operable to remove fluid from the scorecard by squeezing it therebetween and propel it out of the washing device through outlet aperture 16.

The compressive pressure of feeder rollers 20 and wringer rollers 52 upon the scorecard is adjustable by means of screw tightening means 60. In general, the lower roller is held in a fixed position and the pressure of the upper roller upon it is adjustable by turning thumbscrew 62 which in turn adjusts the vertical position of the upper roller.

As is best illustrated by FIG. 2, feeder rollers 20, brushes 42 and wringer rollers 52 are mechanically rotated by a chain and sprocket arrangement driven by electrical motor 70. Chain 72 passes over a sprocket 73 on the drive shaft of the motor to a sprocket 74 attached to the axel of one of the brushes 42, over sprocket 75 attached to the axel of one of the feeder rollers 20 and then back over sprocket 76 attached to the axel of one of the wringer rollers 52. The speed of the rollers and brushes with respect to each other are determined by selection of differing sprocket sizes. It is to be noted that a belt and pulley arrangement could also be utilized for this purpose. The upper and lower rollers and brushes are caused to be rotated in opposite directions by means of simple complementary gear arrangements between corresponding pairs that are commonly known in the machinery industry.

The foregoing detailed description has been given for clearness of understanding only, and no unnecesary limitations should be understood therefrom, as modifications will be obvious to those skilled in the art.

What is claimed is:

1. A device for washing and drying scorecards comprising;

a tank having an inlet aperture and an outlet aperture;

means for conveying a scorecard edgewise through said tank, said conveying means including in part a pair of revolving feeder rollers located at said inlet aperture which receive and pull said scorecard into said tank and propel it through a guide means downward into a cleaning fluid disposed in said tank;

a scrubbing station submerged in the cleaning fluid contained in said tank whereby said fluid is supplied to the scorecard during the scrubbing operation, said scrubbing station including multiple revolving cylindrical brushes positioned above and below said scorecard to receive it from said feeder rollers and to propel it as it passes through said scrubbing station, said brushes being disposed in a vertically staggered arrangement which causes the scorecard to undulate as it passes through the brushes and whereby both sides of said scorecard are washed simultaneously, said brushes positioned above said scorecard revolving in a direction opposite to said brushes positioned below said scorecard and propelling said scorecard through said scrubbing station to a second guide means and through said second guide means to a drying station;

means for drying said scorecard at said drying station comprising a pair of revolving wringer rollers operable to remove said fluid from said scorecard and pull it from said scrubbing station and propel it through said outlet aperture;

means for adjusting the compressive tension of said feeder rollers and said wringer rollers upon said scorecard as it passes between said pairs of rollers; and means for simultaneously revolving said feeder rollers, cylindrical brushes and wringer rollers whereby said scorecard is continuously conveyed through the machine throughout the washing and drying operation.

* * * * *